US008734107B2

(12) United States Patent
Butkiewicz et al.

(10) Patent No.: US 8,734,107 B2
(45) Date of Patent: May 27, 2014

(54) CERAMIC-BASED TIP CAP FOR A TURBINE BUCKET

(75) Inventors: Jeffrey John Butkiewicz, Greenville, SC (US); Stanley Frank Simpson, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 476 days.

(21) Appl. No.: 13/149,426

(22) Filed: May 31, 2011

(65) Prior Publication Data

US 2012/0308392 A1 Dec. 6, 2012

(51) Int. Cl.
*F01D 5/20* (2006.01)

(52) U.S. Cl.
USPC ..... 416/92

(58) Field of Classification Search
CPC ..... F01D 5/20; F01D 5/187; Y02T 50/676
USPC ..... 416/96 R, 241 B, 97 R, 96 A
See application file for complete search history.

(56) References Cited

U.S. PATENT DOCUMENTS

| | | | | | |
|---|---|---|---|---|---|
| 4,010,531 | A * | 3/1977 | Andersen et al. | 29/889.721 |
| 4,020,538 | A | 5/1977 | Dennis et al. | |
| 4,247,254 | A * | 1/1981 | Zelahy | 416/97 R |
| 4,411,597 | A * | 10/1983 | Koffel et al. | 416/92 |
| 4,589,824 | A * | 5/1986 | Kozlin | 416/97 R |
| 5,015,540 | A * | 5/1991 | Borom et al. | 428/698 |
| 5,192,192 | A | 3/1993 | Ourhann | |
| 6,367,687 | B1 * | 4/2002 | Reeves et al. | 228/206 |
| 6,634,860 | B2 | 10/2003 | Lee et al. | |
| 7,001,151 | B2 | 2/2006 | Wang et al. | |
| 7,537,431 | B1 | 5/2009 | Liang | |
| 7,556,477 | B2 | 7/2009 | Sherlock et al. | |
| 8,366,392 | B1 * | 2/2013 | Liang | 416/97 R |
| 2005/0091848 | A1 * | 5/2005 | Nenov et al. | 29/889.1 |

* cited by examiner

*Primary Examiner* — Nathaniel Wiehe
*Assistant Examiner* — Kayla McCaffrey
(74) *Attorney, Agent, or Firm* — Dority & Manning, PA

(57) ABSTRACT

A turbine bucket may generally include an airfoil formed from a metal-based material. The airfoil may include a base and a tip disposed opposite the base. The airfoil may also include a pressure side wall and a suction side wall extending between a leading edge and a trailing edge. Additionally, the turbine bucket may include a tip cap disposed between the pressure side wall and the suction side wall. The tip cap may be formed from a ceramic matrix composite material.

11 Claims, 6 Drawing Sheets

FIG. —1—

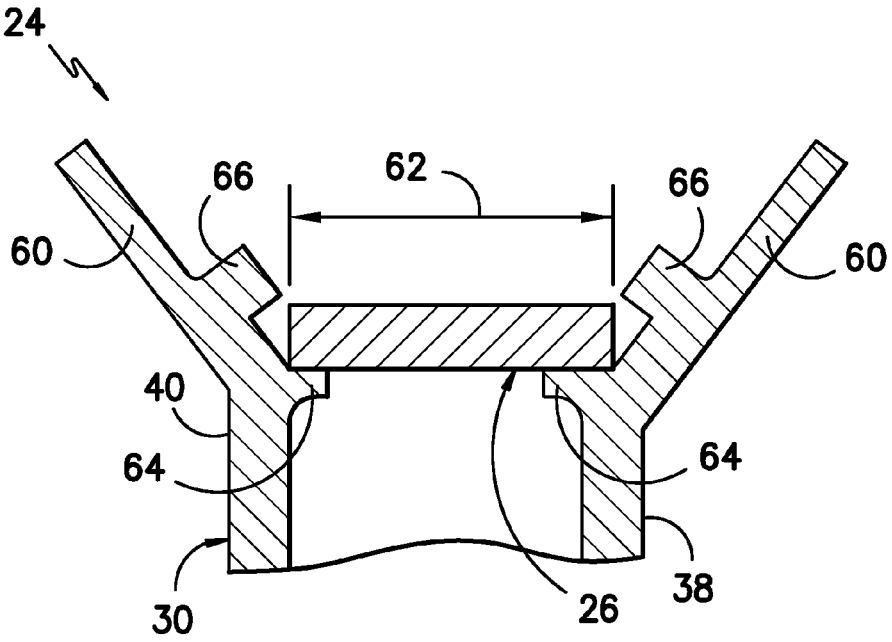
FIG. –5–
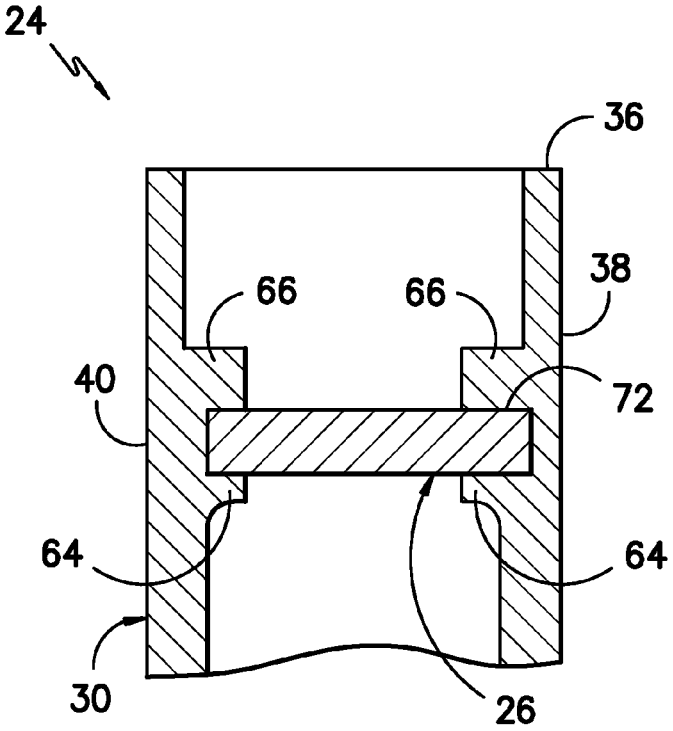
FIG. –6–

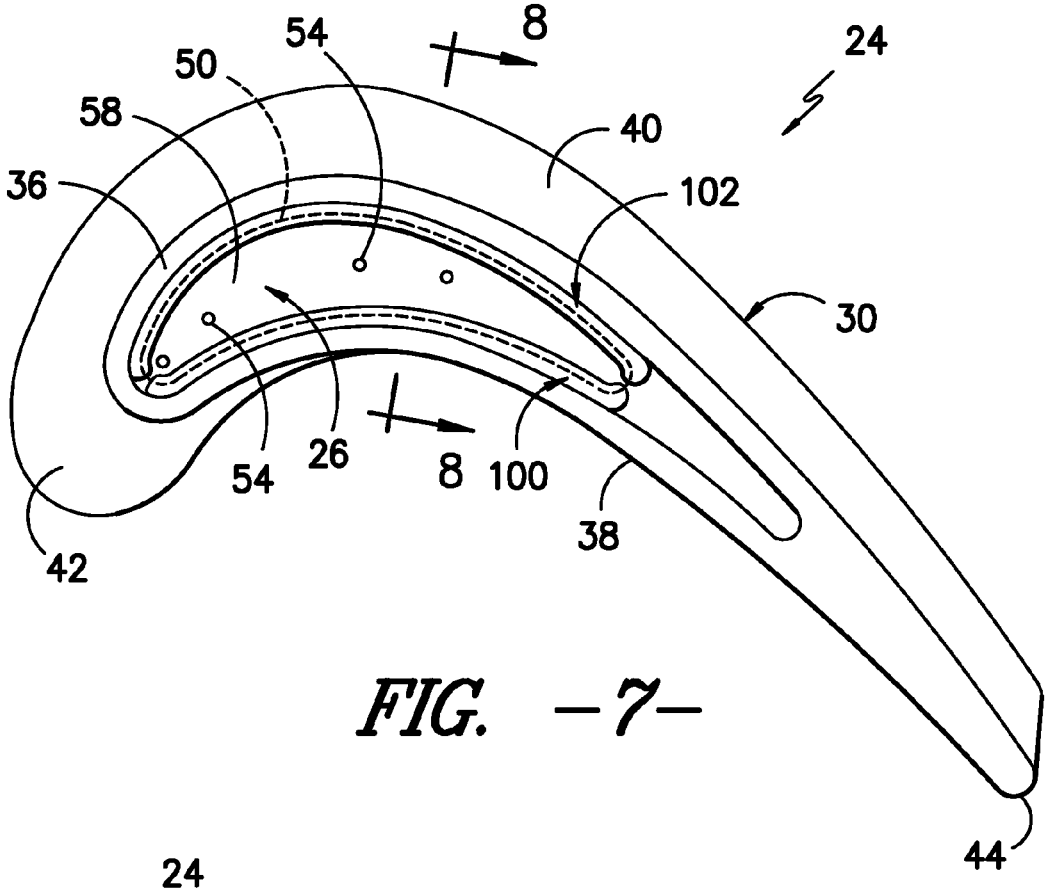
FIG. –7–
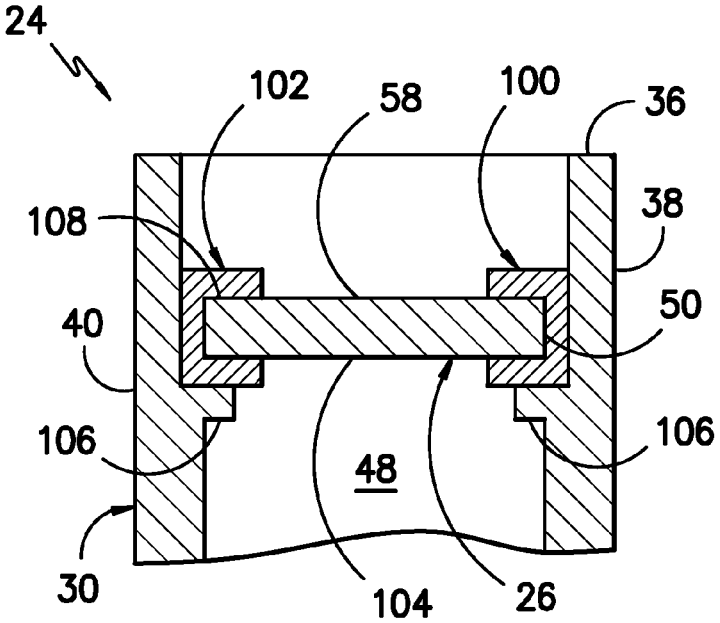
FIG. –8–

CERAMIC-BASED TIP CAP FOR A TURBINE BUCKET

FIELD OF THE INVENTION

The present subject matter relates generally to tip caps for turbine buckets and, more particularly, to a ceramic-based tip cap for a turbine bucket.

BACKGROUND OF THE INVENTION

In a gas turbine, air is pressurized by a compressor and then mixed with fuel and ignited within an annular array of combustors to generate hot gases of combustion. The hot gases flow from each combustor through a transition piece for flow along an annular hot gas path. Turbine stages are typically disposed along the hot gas path such that the hot gases flow through first-stage nozzles and buckets and through the nozzles and buckets of follow-on turbine stages. The turbine buckets may be secured to a plurality of rotor disks comprising the turbine rotor, with each rotor disk being mounted to the rotor shaft for rotation therewith.

A turbine bucket generally includes an airfoil extending radially outwardly from a substantially planar platform and a shank portion extending radially inwardly from the platform for securing the bucket to one of the rotor disks. Additionally, many turbine buckets include a separate tip cap attached to the airfoil for sealing the airfoil tip. Currently, tip caps for turbine buckets are formed from metal-based materials, such as nickel- and cobalt-based superalloys. However, due to the extreme operating temperatures within a gas turbine, such metal-based tip caps must be continuously cooled to survive exposure to the hot gases combustion flowing over and/or around the airfoil tip. Accordingly, a portion of the working fluid of the gas turbine must be utilized to cool the tip cap, thereby decreasing the overall efficiency of the gas turbine. Moreover, metal-based tip caps are typically relatively heavy due to the high densities of metal-based material. As a result, these tip caps typically generate a significant load at the tip of the airfoil during operation, thereby increasing the stress acting on the turbine bucket.

Accordingly, a tip cap formed from a material with high temperature capabilities and/or low densities would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a turbine bucket. The turbine bucket may generally include an airfoil formed from a metal-based material. The airfoil may include a base and a tip disposed opposite the base. The airfoil may also include a pressure side wall and a suction side wall extending between a leading edge and a trailing edge. Additionally, the turbine bucket may include a tip cap disposed between the pressure side wall and the suction side wall. The tip cap may be formed from a ceramic matrix composite material.

In another aspect, the present subject matter is directed to a turbine bucket. The turbine bucket may generally include an airfoil having a base and a tip disposed opposite the base. The airfoil may also include a pressure side wall and a suction side wall extending between a leading edge and a trailing edge. The turbine bucket may also include a tip cap disposed between the pressure side wall and the suction side wall. The tip cap may be formed from a ceramic matrix composite material. Additionally, the turbine bucket may include means for retaining the tip cap between the pressure side wall and the suction side wall.

In a further aspect, the present subject matter is directed to a gas turbine. The gas turbine may generally include a compressor section, a combustor section downstream of the compressor section and a turbine section downstream of the combustor section. The turbine section may include a plurality of turbine buckets. Each turbine bucket may include an airfoil formed from a metal-based material. The airfoil may include a base and a tip disposed opposite the base. The airfoil may also include a pressure side wall and a suction side wall extending between a leading edge and a trailing edge. Additionally, each turbine bucket may include a tip cap disposed between the pressure side wall and the suction side wall. The tip cap may be formed from a ceramic matrix composite material.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 5 illustrates a cross-sectional view of another embodiment of a turbine bucket having a separate tip cover in accordance with aspects of the present subject matter, particularly illustrating the turbine bucket having flared ends;

FIG. 6 illustrates the turbine bucket shown in FIG. 5 after the flared ends have been straightened in accordance with aspects of the present subject matter;

FIG. 7 illustrates a top view of a further embodiment of a turbine bucket having a separate tip cover in accordance with aspects of the present subject matter;

FIG. 8 illustrates a cross-sectional view of the turbine bucket shown in FIG. 7 taken along line 8-8.

DETAILED DESCRIPTION OF THE INVENTION

Figure 1:
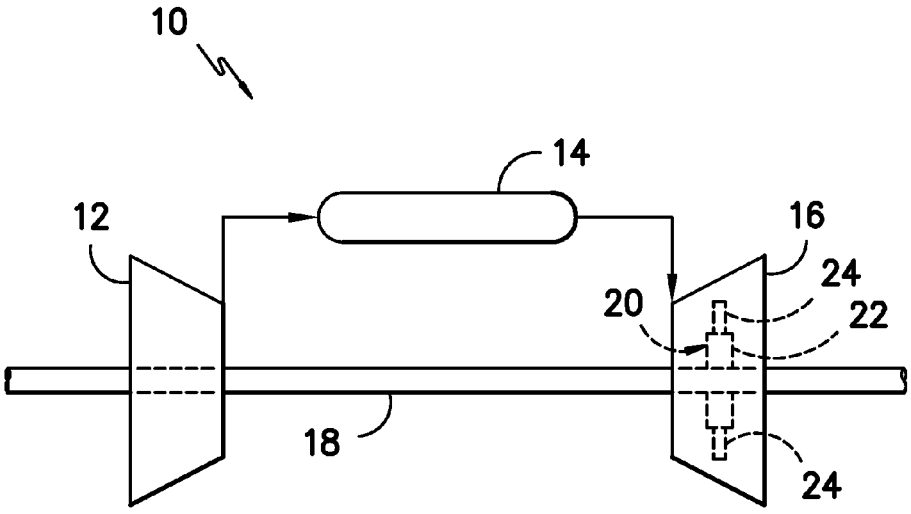
FIG. 1 illustrates a schematic diagram of one embodiment of a gas turbine.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter discloses a turbine bucket for a gas turbine. In particular, the present subject matter is directed to a tip cap for the turbine bucket formed from a ceramic matrix composite (CMC) material. By using CMC materials, the tip cap may generally exhibit enhanced high temperature capabilities as compared to conventional metal-based tip caps. As such, the tip cap may eliminate the need for supplying significant amounts of a medium, such as a cooling medium (e.g., air, water, steam and/or the like), to the tip cap for cooling, thereby increasing the efficiency of the gas turbine. Additionally, because of the low densities of CMC materials, the weight of the tip cap may be significantly less than conventional metal-based tip caps, thereby reducing the loads generated by the tip cap during operation of the gas turbine.

In several embodiments of the present subject mater, it should be appreciated that the tip caps disclosed herein may be designed for retrofit applications and, thus, may be configured to be installed within pre-existing turbine buckets. For example, the tip caps may have the same or a similar shape and/or dimensions as that of a conventional metal-based tip cap such that the tip caps may be directly installed into pre-existing buckets as replacement parts. As such, the numerous advantages provided by the disclosed tip caps may be obtained without the need of installing new turbine buckets within a gas turbine.

Referring now to the drawings, FIG. 1 illustrates a schematic diagram of a gas turbine 10. The gas turbine 10 generally includes a compressor section 12, a plurality of combustors (not shown) within a combustor section 14 disposed downstream of the compressor section 12, and a turbine section 16 disposed downstream of the combustor section 14. Additionally, the gas turbine 10 may include a shaft 18 coupled between the compressor section 12 and the turbine section 16. The turbine section 16 may generally include a turbine rotor 20 having a plurality of rotor disks 22 (one of which is shown) and a plurality of turbine buckets 24 extending radially outwardly from and being coupled to each rotor disk 22 for rotation therewith. Each rotor disk 22 may, in turn, be coupled to a portion of the shaft 18 extending through the turbine section 16.

During operation of the gas turbine 10, the compressor section 12 pressurizes air entering the gas turbine 10 and supplies the pressurized air to the combustors of the combustor section 14. The pressurized air is mixed with fuel and burned within each combustor to produce hot gases of combustion. The hot gases of combustion flow in a hot gas path from the combustor section 14 to the turbine section 16, wherein energy is extracted from the hot gases by the turbine buckets 24. The energy extracted by the turbine buckets 24 is used to rotate the rotor disks 22 which may, in turn, rotate the shaft 18. The mechanical rotational energy may then be used to power the compressor section 12 and generate electricity.

Figure 2:
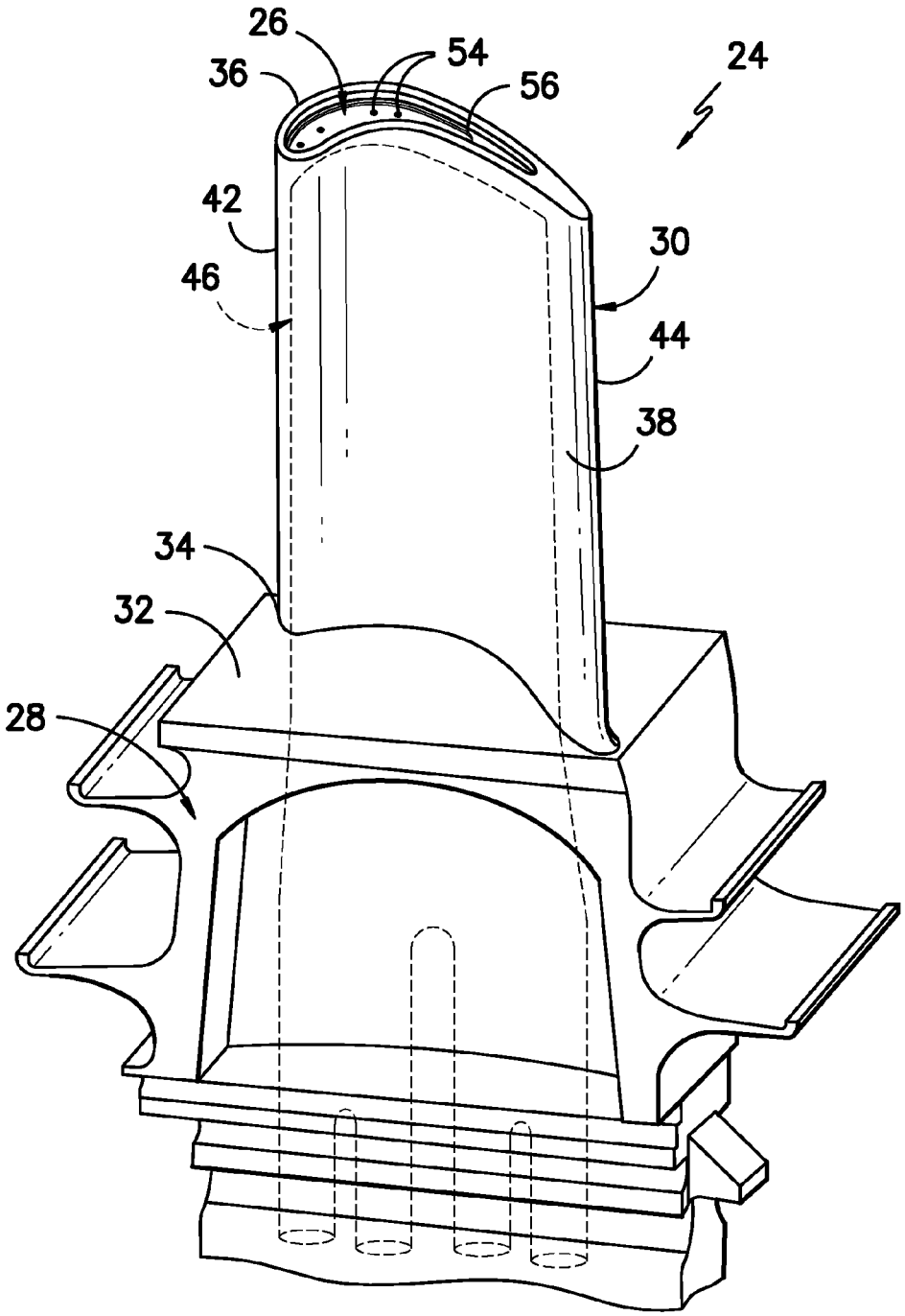
FIG. 2 illustrates a perspective view of one embodiment of a turbine bucket having a separate tip cover in accordance with aspects of the present subject matter.
Figure 3:
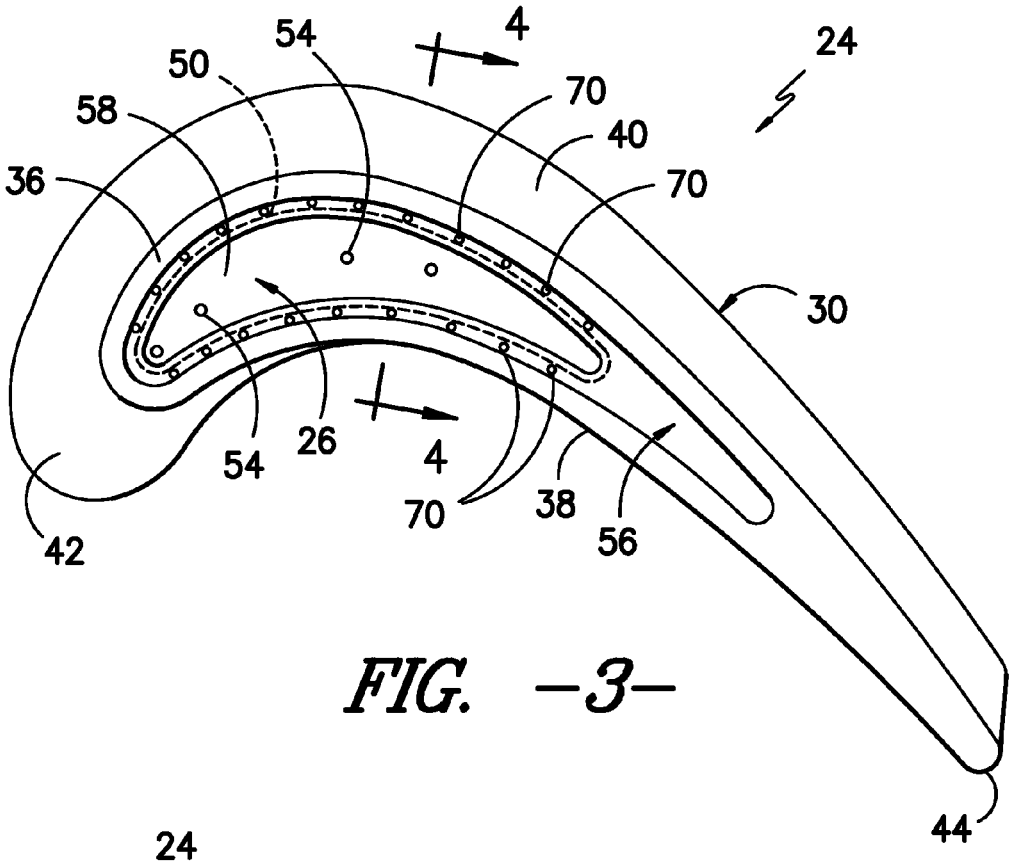
FIG. 3 illustrates a top view of the turbine bucket shown in FIG. 2.
Figure 4:
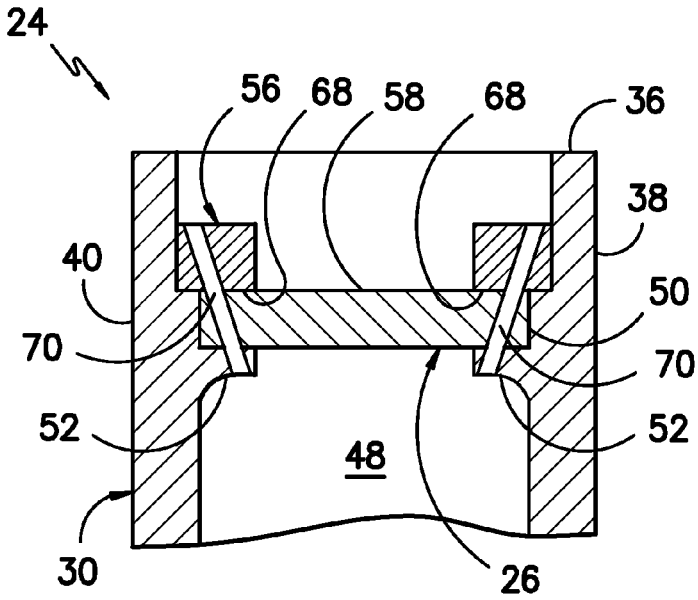
FIG. 4 illustrates a cross-sectional view of the turbine bucket shown in FIGS. 2 and 3 taken along line 4-4.

Referring now to FIGS. 2-4, one embodiment of a turbine bucket 24 having a separate tip cap 26 installed therein is illustrated in accordance with aspects of the present subject matter. In particular, FIG. 2 illustrates a perspective view of the turbine bucket 24. FIG. 3 illustrates a top view of the turbine bucket 24. Additionally, FIG. 4 illustrates a cross-sectional view of the turbine bucket 24 taken along line 4-4.

As shown, the turbine bucket 24 generally includes a shank portion 28 and an airfoil 30 extending from a substantially planar platform 32. The platform 32 generally serves as the radially inward boundary for the hot gases of combustion flowing through the turbine section 16 of the gas turbine 10 (FIG. 1). The shank portion 28 may generally be configured to extend radially inwardly from the platform 32 and may include a root structure (not shown), such as a dovetail, configured to secure the bucket 24 to the rotor disk 22 of the gas turbine 10 (FIG. 1).

The airfoil 30 may generally extend radially outwardly from the platform 32 and may include an airfoil base 34 disposed at the platform 32 and an airfoil tip 36 disposed opposite the airfoil base 34. Thus, the airfoil tip 36 may generally define the radially outermost portion of the turbine bucket 24. The airfoil 30 may also include a pressure side wall 38 and a suction side wall 40 (FIGS. 3 and 4) extending between a leading edge 42 and a trailing edge 44. The pressure side wall 38 may generally comprise an aerodynamic, concave outer wall of the airfoil 30. Similarly, the suction side wall 40 may generally define an aerodynamic, convex outer wall of the airfoil 30.

Additionally, the turbine bucket 24 may also include an airfoil cooling circuit 46 extending radially outwardly from the shank portion 28 for flowing a medium, such as a cooling medium (e.g., air, water, steam or any other suitable fluid), throughout the airfoil 30. The airfoil circuit 46 may generally have any suitable configuration known in the art. Thus, in several embodiments, the airfoil circuit 46 may include a plurality of channels or passages 48 (one of which is shown in the cross-sectional view of FIG. 4) extending radially within the airfoil 30, such as from the airfoil base 34 to a location generally adjacent the airfoil tip 36. For example, in one embodiment, the airfoil circuit 46 may be configured as a multiple-pass cooling circuit, with the passages 48 being interconnected and extending radially inward and radially outward within the airfoil 30 (e.g., in a serpentine-like path) such that the medium within the passages 48 flows alternately radially outwardly and radially inwardly throughout the airfoil 30.

It should be appreciated that the various components of the turbine bucket 24 (e.g., the airfoil 30, platform 32 and shank portion 28) may generally be formed from any suitable metal-based material. For example, in several embodiments, the turbine bucket 24 may be formed from nickel alloy steels, nickel-based superalloys, cobalt-based superalloys and/or any other suitable high-temperature alloys. It should also be appreciated that application of the present subject matter need not be limited to the particular turbine bucket configuration and/or materials illustrated and described herein. Rather, the present subject matter may be beneficially applied to turbine buckets having any suitable configuration and/or turbine buckets formed from any suitable materials.

Referring still to FIGS. 2-4, as indicated above, the turbine bucket 24 may also include a separate tip cap 26 configured to be attached to the airfoil 30 at the airfoil tip 36 to generally provide a closed volume within the airfoil 30 and/or to retain the medium flowing through airfoil circuit 46 within the airfoil 30. In general, the tip cap 26 may be configured to be attached to the airfoil 30 between the pressure side wall 38 and the suction side wall 40. Thus, in several embodiments, the tip cap 26 may be shaped and/or otherwise dimensioned so that it may be positioned between the pressure side wall 38 and the suction side wall 40 (FIGS. 3 and 4) at a location generally adjacent the airfoil tip 36. For example, as particularly shown in FIG. 3, the tip cap 26 (the outer perimeter 50 of which is shown in dashed lines) may be configured to have a shape generally corresponding to the aerodynamic shape of the airfoil 30. As such, when the tip cap 26 is installed between the pressure side wall 38 and the suction side wall 40, the tip cap 26 may generally conform to the concave and convex shapes of the pressure and suction side walls 38, 40, respectively. However, in alternative embodiments, the tip cap 26 may have any other suitable shape that permits it to be positioned between the pressure and suction side walls 38, 40.

Additionally, the tip cap 26 may generally be configured to be supported between the pressure side wall 38 and the suction side wall 40 using any suitable structure and/or configuration known in the art. For example, as shown in FIG. 4, the turbine bucket 24 may include a shoulder 52 projecting inwardly from the pressure and suction side walls 38, 40. Thus, when the tip cap 26 is installed between the pressure side wall 38 and the suction side wall 40, the tip cap 26 may be radially supported within the airfoil 30 at the airfoil tip 36 by the shoulder 52. In alternative embodiments, turbine bucket 24 may include any other suitable feature for radially supporting the tip cap 26 within the airfoil 30.

Moreover, as shown in FIGS. 2 and 3, in one embodiment, one or more dust holes 54 may be defined through the tip cap 26 for expelling dust and/or other debris contained within the medium supplied through the airfoil circuit 46. For example, the dust holes 54 may be defined in the tip cap 26 so as to be aligned with the passages 48 of the airfoil circuit 46. As such, any dust and/or debris carried within medium may be expelled from the passages 48 through the dust holes 54.

Further, as indicated above, the tip cap 26 may generally be formed from a ceramic matrix composite (CMC) material. In general, the CMC material used to form the tip cap 26 may comprise any suitable CMC material known in the art and, thus, may generally include a ceramic matrix having a suitable reinforcing material incorporated therein to enhance the material's properties (e.g., the material strength and/or the thermo-physical properties). In several embodiments, the CMC material used may be configured as a continuous fiber reinforced CMC material. For example, suitable continuous fiber reinforced CMC materials may include, but are not limited to, CMC materials reinforced with continuous carbon fibers, oxide fibers, silicon carbide monofilament fibers and other CMC materials including continuous fiber lay-ups and/or woven fiber performs. In other embodiments, the CMC material used may be configured as a discontinuous reinforced CMC material. For instance, suitable discontinuous reinforced CMC materials may include, but are not limited to, particulate, platelet, whisker, discontinuous fiber, in situ and nano-composite reinforced CMC materials. Moreover, it should be appreciated that the disclosed tip cap 26 may be formed from the CMC material using any suitable manufacturing process known in the art. For example, suitable manufacturing processes may include, but are not limited to, injection molding, slip casting, tape casting, infiltration methods (e.g., chemical vapor infiltration, melt infiltration and/or the like) and various other suitable methods and/or processes.

As indicated above, by forming the tip cap 26 out of a CMC material, numerous advantages may be provided. For example, the high temperature capabilities of CMC materials may eliminate the need to utilize a portion of the medium flowing through the airfoil circuit 46 to cool the tip cap 26, thereby reducing the total amount of medium required to cool the turbine bucket 24 and increasing the overall efficiency of the gas turbine 10 (FIG. 1). Additionally, the elimination of the need to cool the tip cap 26 may allow for the tip cap 26 to be designed without the film cooling holes typically required for metal-based tip caps, thereby reducing the component's complexity and also reducing manufacturing costs. Moreover, CMC materials generally have a lower density than metal-based materials. Thus, the tip cap 26 may have a reduced weight as compared to similarly configured metal-based tip caps, thereby reducing the load generated by the tip cap 26 during operation of the gas turbine 10. As such, the total stress acting on the turbine bucket 24 may be reduced.

Referring still to FIGS. 2-4, the tip cap 26 may generally be configured to be radially retained between the pressure side wall 38 and the suction side wall 40 using any suitable means. For example, as shown in the illustrated embodiment, the tip cap 26 may be retained between the pressure side wall 38 and the suction side wall 40 using a retaining ring 56. In general, the retaining ring 56 may be configured to be attached between the pressure and suction side walls 38, 40 at a location radially outwardly from the tip cap 26 such that the tip cap 26 is radially retained between the shoulder 52 and the retaining ring 56. Thus, in several embodiments, the retaining ring 56 may be configured to be attached around the inner perimeter of the pressure and suction side walls 38, 40 such that at least a portion of the retaining ring 56 overlaps and/or is in contact with an outer surface 58 of the tip cap 26. For instance, as particularly shown in FIGS. 3 and 4, the retaining ring 56 may be configured to overlap and/or be in contact with the outer surface 58 around the outer perimeter 50 of the tip cap 26. As such, a sealing surface 68 may be defined at the interface between the retaining ring 56 and the tip cap 26.

It should be appreciated that the retaining ring 56 may generally have any suitable shape and/or configuration that allows it to function as described herein. For example, as shown in the illustrated embodiment, the retaining ring 56 may be configured to have a shape generally corresponding to both the aerodynamic shape of the airfoil 30 and the shape of the tip cap 26. As such, when the retaining ring 56 is installed between the pressure side wall 38 and suction side wall 40, the retaining ring 56 may generally conform to the concave and convex shapes of the pressure and suction side walls 38, 40, respectively and may also engage the tip cap 26 around its outer perimeter 50. However, in alternative embodiments, the retaining ring 56 may have any other suitable shape that permits it to be attached between the pressure and suction side walls 38, 40 so as to radially retain the tip cap 26 within the airfoil 30.

It should also be appreciated that the retaining ring 56 may be attached between the pressure and suction side walls 38, 40 using any suitable attachment method known in the art. Thus, in one embodiment, the retaining ring 56 may be welded or brazed to the pressure and/or suction side walls 38, 40. For instance, in the illustrated embodiment, the retaining ring 56 may be configured to be welded or brazed to the pressure and suction side 38, 40 walls along the entire inner perimeter of the airfoil 30. Alternatively, the retaining ring 56 may be attached between the pressure and suction side walls 38, 40 using various other suitable attachment methods, such as by using suitable fastening mechanisms (e.g., bolts, screws, retaining pins, brackets, rivets, and/or other suitable mechanical fasteners).

Moreover, in several embodiments of the present subject matter, the turbine bucket 24 may include a plurality of cooling holes 70 defined in the airfoil 30, tip cap 26 and/or retaining ring 56 for directing the medium (e.g., air, water, steam and/or the like) supplied through the airfoil circuit 48 to the portions of the airfoil 30 disposed radially outwardly from the tip cap 26. For instance, as shown in FIGS. 3 and 4, a plurality of cooling holes 70 may be defined through portions of the airfoil 30 (e.g., the shoulder 52), the tip cap 26 and the retaining ring 56. As such, the medium supplied though the airfoil circuit 48 may be directed through the cooling holes 70 to provide impingement and/or film cooling around the inner perimeter of the airfoil 30 and at the airfoil tip 36. However, in alternative embodiments, the cooling holes 70 may have any other suitable arrangement within the turbine bucket 24 that provides beneficial cooling to the inner perimeter of the airfoil 30 and/or the airfoil tip 36. For example, in one embodiment, the cooling holes 70 may only be defined through portions of the tip cap 26 and the retaining ring 56. In another embodiment, the cooling holes may only be defined through the tip cap 26.

Referring now to FIGS. 5 and 6, there is illustrated another embodiment of a suitable means for retaining the tip cap 26 between the pressure and suction side walls 38, 40 of the turbine bucket 24. As shown in FIG. 5, the pressure and suction side walls 38, 40 may initially include flared ends 60 configured to be angled outwardly at the airfoil tip 36. In particular, the flared ends 60 may be designed to be angled outwardly a sufficient width 62 such that the tip cap 26 may be inserted between the pressure and suction side walls 38, 40 and positioned onto a radially inner shoulder 64 projecting inwardly from the side walls 38, 40. Once the tip cap 26 is positioned onto the radially inner shoulder 64, the flared ends 60 may be straightened and/or otherwise formed into the configuration shown in FIG. 6, wherein the tip cap 26 is captured between the radially inner shoulder 64 and a radially outer shoulder 66 projecting inwardly from the pressure and suction side walls 38, 40 so that a sealing surface 72 may be defined at the interface between the tip cap 26 and the radially outer shoulder 66. As such, the tip cap 26 may be securely retained between the pressure and suction side walls 38, 40. Additionally, upon the straightening of the flared ends 60, the pressure and suction side walls 38, 40 may generally define a smooth, aerodynamic contour along the entire radial height of the airfoil 30. It should be appreciated that the flared ends 60 may be straightened using any suitable method known in the art, such as by crimping, rolling and/or bending the flared ends 60 into the configuration shown in FIG. 6.

Referring now to FIGS. 7 and 8, there is illustrated a further embodiment of a suitable means for retaining the tip cap 26 between the pressure and suction side walls 38, 40 of the turbine bucket 24. As shown, the tip cap 26 may be radially retained between the pressure side wall 38 and the suction side wall 40 using a multi-piece retaining ring 100, 102 configured similar to the retaining ring 56 described above with reference to FIGS. 2-4. In several embodiments, the multi-piece retaining ring 100, 102 may include a first retaining ring section 100 and a second retaining ring section 102 configured to be disposed around the tip cap 26 such that at least a portion of each ring section 100, 102 engages, overlaps and/or is in contact with the outer surface 58 and/or an inner surface 104 of the tip cap 26. For instance, as shown in FIG. 8, in one embodiment, the first and second retaining ring sections 100, 102 may each have a "U" shaped profile so that the ring sections 100, 102 may engage, overlap and/or be in contact with both the outer surface 58 and the inner surface 104 around all or a portion of the outer perimeter 50 of the tip cap 26. As such, when the ring sections 100, 102 are attached between the pressure and suction side walls 38, 40, the tip cap 26 may be radially retained within the airfoil 30 and a sealing surface 108 may be defined at the interface between the ring sections 100, 102 and the tip cap 26.

It should be appreciated that, similar to the retaining ring 56 described above, the first and second retaining ring sections 100, 102 may generally have any suitable shape and/or configuration that allows such ring sections 100, 102 to function as described herein. For example, as shown in the illustrated embodiment, the retaining ring sections 100, 102 may be configured to have a shape generally corresponding to the aerodynamic shape of both the airfoil 30 and the tip cap 26. Specifically, the first retaining ring section 100 may generally have a shape corresponding to aerodynamic shape of both the pressure side wall 38 and the corresponding side of the tip cap 26 and the second retaining ring section 102 may generally have a shape corresponding to the aerodynamic shape of both the suction side wall 40 and the corresponding side of the tip cap 26. However, in alternative embodiments, the retaining ring sections 100, 102 may have any other suitable shape that permits the ring sections 100, 102 to be attached between the pressure and suction side walls 38, 40 so as to radially retain the tip cap 26 within the airfoil 30.

Additionally, it should be appreciated that the first and second retaining ring sections 100, 102 may be configured to be attached between the pressure and suction side walls 38, 40 using any suitable attachment method known in the art. Thus, in several embodiments, the ring sections 100, 102 may be welded or brazed to the pressure and/or suction side walls 38, 40. For instance, in the illustrated embodiment, the first retaining ring section 100 may be configured to be welded or brazed along the inner surface of the pressure side wall 38 and the second retaining ring section 102 may be configured to be welded or brazed along the inner surface of the suction side wall 40. Alternatively, the ring sections 100, 102 may be attached between the pressure and suction side walls 38, 40 using various other suitable attachment methods, such as by using suitable fastening mechanisms (e.g., bolts, screws, retaining pins, brackets, rivets, and/or other suitable mechanical fasteners). Moreover, as shown in FIG. 8, in one embodiment, the ring sections 100, 102 may be configured to be radially supported by a shoulder 106 projecting inwardly from the pressure and suction side walls 38, 40 when the ring sections 100, 102 are attached between the side walls 38, 40.

Figure 9:
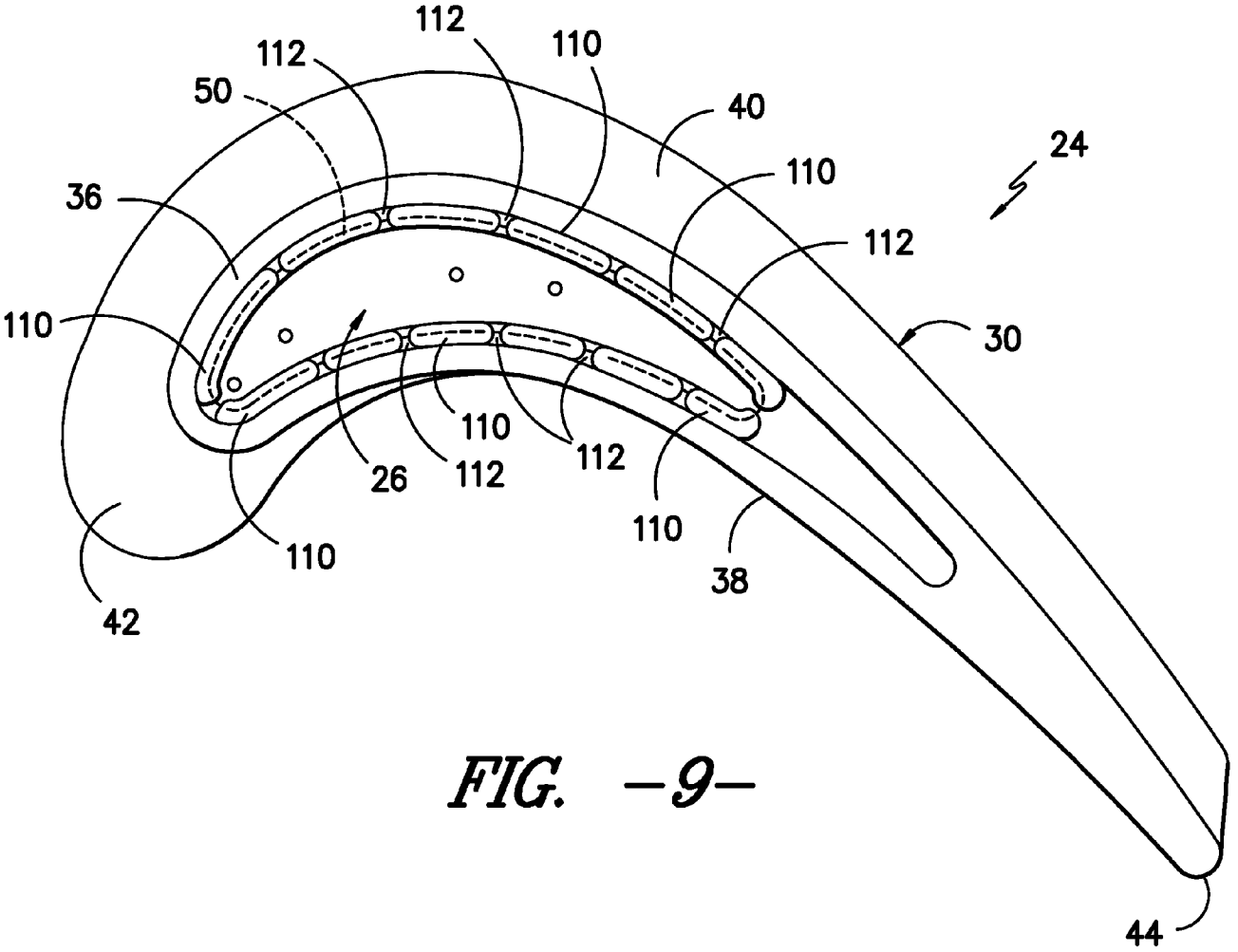
FIG. 9 illustrates a top view of yet another embodiment of a turbine bucket having a separate tip cover in accordance with aspects of the present subject matter.

Further, it should be appreciated that, in several embodiments, the multi-piece retaining ring 100, 102 may include more than two retaining ring sections. For instance, in one embodiment, three or more ring sections may be configured to be both engaged around the outer perimeter 50 of the tip cap 26 and attached between the pressure and suction side walls 38, 40 so as to radially retain the tip cap 26 within the airfoil 30. In such an embodiment, it may be desirable for the ring sections to be spaced apart from one another to permit the medium (e.g., air, water, steam and/or the like) supplied through the airfoil circuit 48 to be directed between the ring sections for cooling the airfoil tip 36. For example, FIG. 9 illustrates one embodiment of a multi-piece retaining ring formed from a plurality of ring sections 110. As shown, the ring sections 110 may be spaced apart around outer perimeter 50 of the tip cap 26 such that a plurality of cooling passages or holes 112 may be defined between adjacent ring sections 110. As such, the medium contained within the airfoil cooling circuit 48 (FIG. 8) may be directed between the outer perimeter 50 of the tip cap 26 and the inner perimeter of the airfoil 30 and through the cooling holes 112 in order to provide beneficial cooling to the airfoil tip 36.

It should also be appreciated that, in alternative embodiments, the tip cap 26 may be retained between the pressure and suction side walls 38, 40 using any other suitable means. For example, in one embodiment, one or more holes may be defined in the pressure and/or suction side walls 38, 40 and the tip cap 26 for receiving one or more retaining pins and/or rods. The pins and/or rods may then be inserted through the pressure and/or suction side walls 38, 40 and into the tip cap 26 in order to retain the tip cap 26 within the airfoil 30. Alternatively, the pins and/or rods may be configured to be inserted through the tip cap 26 into a portion of the pressure and/or suction side walls 38, 40 (e.g., the shoulder 52 extending from the side walls 38, 40). In other embodiments, the tip cap 26 may be retained between the pressure and suction side walls 38, 40 using various other suitable fastening mechanisms, such as screws, bolts, brackets, rivets and/or other suitable mechanical fasteners.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A turbine bucket comprising:

an airfoil formed from a metal-based material, the airfoil including a base and a tip disposed opposite the base, the airfoil further including a pressure side wall and a suction side wall extending between a leading edge and a trailing edge;

a tip cap disposed between the pressure side wall and the suction side wall, the tip cap being formed from a ceramic matrix composite material; and a retaining ring attached between the pressure side wall and the suction side wall radially outwardly from the tip cap, wherein at least one cooling hole is defined through both the tip can and the retaining ring such that a cooling medium flowing within the airfoil is directed through the tip cap and into the retaining ring prior to be expelled from the turbine bucket.

2. The turbine bucket of claim 1, wherein the tip cap is radially supported within the airfoil by a shoulder extending inwardly from the pressure and suction side walls, the retaining ring being attached between the pressure side wall and the suction side wall such that the tip cap is radially retained between the shoulder and the retaining ring.

3. The turbine bucket of claim 1, wherein the retaining ring comprises at least one of a first retaining ring section and a second retaining ring section.

4. The turbine bucket of claim 3, wherein the first and second retaining ring sections have a generally "U" shaped profile.

5. The turbine bucket of claim 1, wherein the ceramic matrix material comprises at least one of a continuous fiber reinforced ceramic matrix material and a discontinuous reinforced ceramic matrix material.

6. A turbine bucket comprising:

an airfoil including a base and a tip disposed opposite the base, the airfoil further including a pressure side wall and a suction side wall extending between a leading edge and a trailing edge;

a tip cap disposed between the pressure side wall and the suction side wall, the tip cap being formed from a ceramic matrix composite material; and a retaining ring attached between the pressure side wall and the suction side wall, the retaining ring being segmented into two or more ring sections extending around an inner perimeter of the pressure and suction sidewall, wherein the two or more ring sections are spaced apart from one another such that a cooling passage is defined between each pair of adjacent ring sections that allows a cooling medium flowing within the airfoil to be directed between the tip cap and at least one of the pressure side wall or the suction side wall.

7. The turbine bucket of claim 6, wherein the tip cap is radially supported by a shoulder extending inwardly from the pressure and suction side walls.

8. The turbine bucket of claim 6, wherein the two or more ring sections have a generally "U" shaped profile.

9. The turbine bucket of claim 6, wherein the ceramic matrix material comprises at least one of a continuous fiber reinforced ceramic matrix material or a discontinuous reinforced ceramic matrix material.

10. The turbine bucket of claim 6, further comprising a plurality of cooling holes defined in or adjacent to the tip cap for cooling the tip of the airfoil.

11. A gas turbine comprising:

a compressor section;

a combustor section downstream of the compressor section; and a turbine section downstream of the combustor section, the turbine section including plurality of turbine buckets, each of the plurality of turbine buckets comprising:

an airfoil formed from a metal-based material, the airfoil including a base and a tip disposed opposite the base, the airfoil further including a pressure side wall and a suction side wall extending between a leading edge and a trailing edge;

a tip cap disposed between the pressure side wall and the suction side wall, the tip cap being formed from a ceramic matrix composite material; and a retaining ring attached between the pressure side wall and the suction side wall radially outwardly from the tip cap, wherein at least one cooling hole is defined through both the tip cap and the retaining ring such that a cooling medium flowing within the airfoil is directed through the tip cap and into the retaining ring prior to be expelled from the turbine bucket.

* * * * *